US006151762A

United States Patent [19]

Cox

[11] Patent Number: 6,151,762

[45] Date of Patent: Nov. 28, 2000

[54] CASKET TOP INTERIOR

[75] Inventor: Gary L. Cox, Richmond, Ind.

[73] Assignee: Vandor Corporation, Richmond, Va.

[21] Appl. No.: 09/105,967

[22] Filed: Jun. 26, 1998

Related U.S. Application Data

[60] Provisional application No. 60/057,476, Sep. 3, 1997.

[51] Int. Cl.[7] ..... A61G 17/00

[52] U.S. Cl. ..... 27/19; 27/14

[58] Field of Search ..... 27/19, 14; D99/10; 220/495.01; 493/93; 229/165

[56] References Cited

U.S. PATENT DOCUMENTS

| | | | |
|---|---|---|---|
| 2,867,030 | 1/1959 | Hillenbrand | 27/19 |
| 2,947,059 | 8/1960 | Hillenbrand | 27/19 |
| 2,964,824 | 12/1960 | Hillenbrand | 27/19 |
| 3,077,016 | 2/1963 | White | 27/19 |
| 3,162,923 | 12/1964 | Kaeser . | |
| 3,204,318 | 9/1965 | Ross | 27/19 |
| 3,228,085 | 1/1966 | Nelson . | |
| 3,344,494 | 10/1967 | McClive | 27/19 |
| 3,395,431 | 8/1968 | Carson, Jr. | 27/19 |
| 3,487,513 | 1/1970 | Herring et al. | 27/19 |
| 3,773,244 | 11/1973 | Dunlap, III et al. | 229/165 X |
| 4,003,109 | 1/1977 | Matichak . | |
| 4,357,741 | 11/1982 | Winburn et al. . | |
| 4,457,054 | 7/1984 | Craft et al. . | |
| 4,639,985 | 2/1987 | Craft . | |
| 4,657,608 | 4/1987 | Schebler et al. . | |
| 4,868,957 | 9/1989 | Rojdev . | |
| 4,962,574 | 10/1990 | Estes | 27/19 X |
| 5,495,648 | 3/1996 | Rojdev et al. . | |
| 5,634,247 | 6/1997 | Bowling . | |
| 5,636,419 | 6/1997 | Foye . | |
| 5,675,877 | 10/1997 | Lewis . | |

FOREIGN PATENT DOCUMENTS

| | | | |
|---|---|---|---|
| 2206334 | 1/1989 | United Kingdom | 27/19 |

*Primary Examiner*—Terry Lee Melius
*Assistant Examiner*—William L. Miller
*Attorney, Agent, or Firm*—Maginot, Addison & Moore

[57] ABSTRACT

A center panel for use in a casket top includes a panel frame and a section of flexible material. The panel base includes a panel base and a plurality of folded-under tabs, the panel base having a first side and a second side. Each of the folded-under tabs is integrally formed with the panel base and is folded under a portion of the panel base, thereby defining at least a portion of a periphery of the panel base. Each of the folded-under tabs is furthermore affixed to the second side of the panel base. The section of flexible material substantially covers the first side of the panel base and is affixed to said folded-under tabs.

21 Claims, 4 Drawing Sheets

CASKET TOP INTERIOR

CROSS REFERENCE TO RELATED APPLICATIONS

This application claims the benefit of U.S. Provisional Patent Application No. 60/057,476, filed Sep. 3, 1997.

FIELD OF THE INVENTION

The present invention relates generally to casket tops, and more particularly, to decorative casket top interiors.

BACKGROUND OF THE INVENTION

Burial caskets often include a decorative lid underside, or casket top interior, for purposes of viewing. In particular, during the viewing period, the casket lid is often opened to permit viewing of the deceased. The lid may fully open, or partially open over the top portion of the body. While open, the casket top interior is prominently displayed. It is thus desirable for the casket top interior, or at least the portion that opens for the viewing, to be aesthetically pleasing.

To this end, the casket industry has widely employed certain decorative mechanisms in casket top interior design. One common casket top interior design includes rolls and a center panel. Rolls are shaped design features that extend inward from each edge of the casket top to form a picture frame effect. The center panel is disposed within the casket top such that the center panel is substantially bordered by the rolls. Both the center panel and rolls are typically cloth covered and hide the otherwise functional and non-aesthetic underside of the metal or wood casket.

Because of the prominent nature of the casket top interior during the viewing, a desirable feature offered by casket manufacturers are center panels having select ornamental designs. The center panel may include religious symbols, poetry, or prayer material deemed appropriate for the deceased. Such designs are typically embroidered or otherwise affixed to fabric, which is then glued or stapled to the center board. Preferably, the center panels are interchangeable such that casket consumers can select a personalized decorative center panel for installation into one of a number of standard casket models. In any event, most center panels are constructed of a semi-rigid or rigid base panel and a fabric covering.

A drawback to the use in such center panels is that undesirably labor-intensive manufacturing methods are currently employed to affix the fabric, decorative or otherwise, to the panel structure. Center panels are typically constructed by stretching fabric over a corrugated paper base and stapling the fabric thereto. Such construction is undesirably labor intensive because the fabric must be centered and tightly held around the paper base and stapled in place simultaneously. Such an operation requires considerable effort because the fabric must be stapled on the opposite side of the panel from the ornamental design for aesthetic reasons. Accordingly, the fabric must be held taught and steady in perfect alignment on one side of the center panel and stapled (or glued) on the other side. Not only is such a method labor intensive, but the difficulties in coordinating the alignment of the design and the stapling from the opposite side often leads to a nonconforming and unusable final product.

A need exists, therefore, for a center panel design having reduced difficulty and reduced labor effort in manufacturing.

SUMMARY OF THE INVENTION

The present invention fulfills the above need, as well as others by providing a center panel having a panel frame that has a plurality of folded-under tabs. The folded-under tabs provide a surface to which the decorative fabric or other flexible material may be affixed, preferably before the tabs are folded under the remaining panel base. In this manner, the flexible material is easily attached and then pulled taut as the tabs are folded under. The resulting center panel is more easily manufactured because of the ease of attaching and tightening the flexible material to the panel base.

An exemplary embodiment of the present invention includes a center panel for use in a casket top. The center panel includes a panel frame and a section of flexible material. The panel frame includes a panel base and a plurality of folded-under tabs, the panel base having a first side and a second side. Each of said folded-under tabs are integrally formed with said panel base and folded under a portion of said panel base, thereby defining at least a portion of a periphery of the panel base. Each of the folded-under tabs are furthermore affixed to the second side of the panel base. The section of flexible material substantially covers the first side of the panel base and is affixed to said folded-under tabs.

An exemplary method of manufacturing a center panel according to the present invention produces a center panel that comprises a panel frame and a section of flexible material. The panel frame includes a panel base and a plurality of tabs, each of the plurality of tabs extending outward from an edge of the panel base, and the panel base having a first side and a second side. In a first step, the section of flexible material is disposed such that it substantially covers the first side of the panel base. In a second step, the section of flexible material is affixed to the tabs. Finally, a third step of the exemplary method of manufacturing a center panel includes folding the tabs under the panel base and affixing the folded-under tabs to the second side of the panel base.

Accordingly, the center panel of the present invention is readily manufactured without awkward and labor-intensive techniques for attaching the decorative fabric or flexible material to the center panel. Preferably the panel base comprises die-cut corrugated paper, slit-scored at the intersection of the folded-under tabs and the panel base to facilitate folding. The use of corrugated paper further reduces manufacturing complexity and cost, and allows for the use of hot melt or thermoplastic adhesives or staples for affixing the flexible material.

The above features and advantages, as well as others, will become more readily apparent to those of ordinary skill in the art by reference to the following detailed description and accompanying drawings.

DETAILED DESCRIPTION

Figure 1:
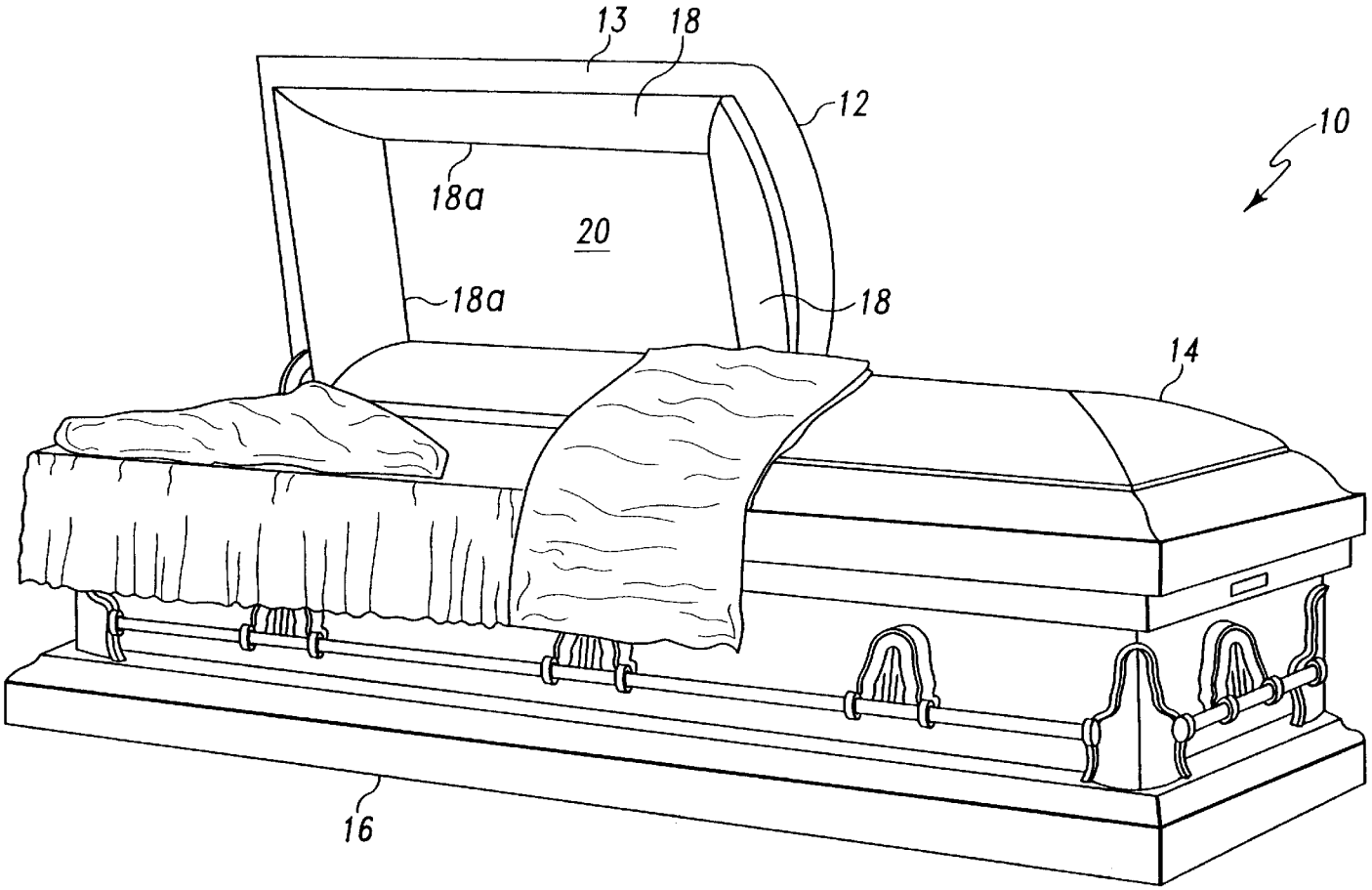
FIG. 1 shows a perspective view of a burial casket having a casket top interior according to the present invention.

FIG. 1 shows a burial casket 10 having a casket top interior assembly according to the present invention. In general, the burial casket 10 includes an first casket top section 12, a second casket top section 14, a base enclosure 16, and a casket top interior assembly comprising a center panel 20 and a plurality of rolls 18. The burial casket 10 is shown with the first casket top section 12 open in a position to allow viewing of the deceased. It is noted that the use of a casket top having first and second sections is given by way of example. The present invention is also readily incorporated into caskets having a singular piece casket top.

Figure 3:
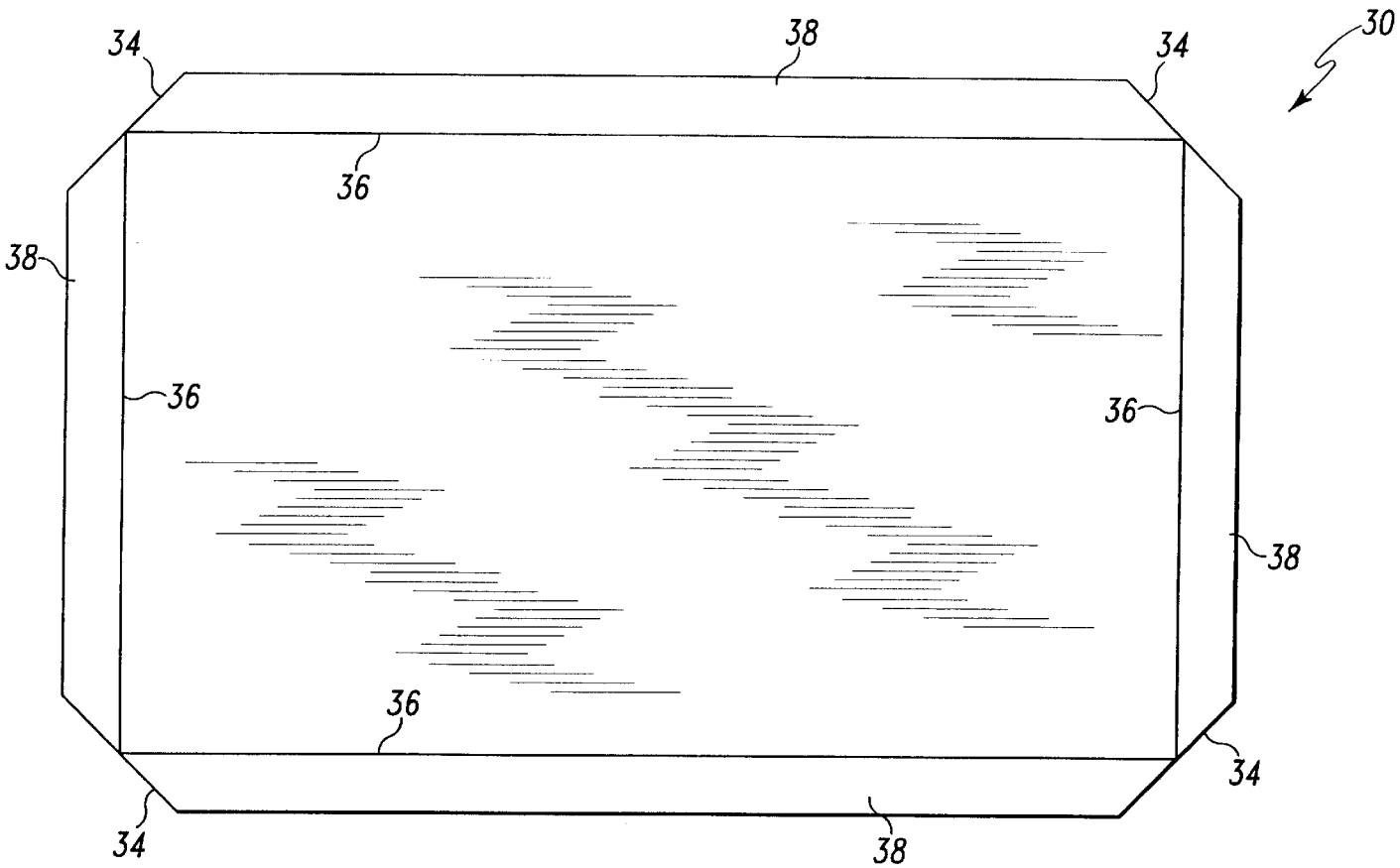
FIG. 3 shows an exemplary panel frame of a center panel according to the present invention.
Figure 4:
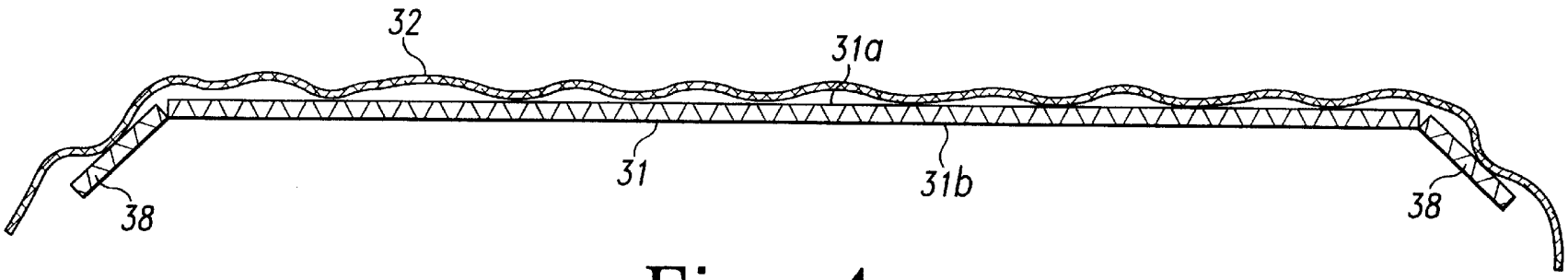
FIG. 4 shows a side cutaway view of a partially assembled center panel according to the present invention.
Figure 5:
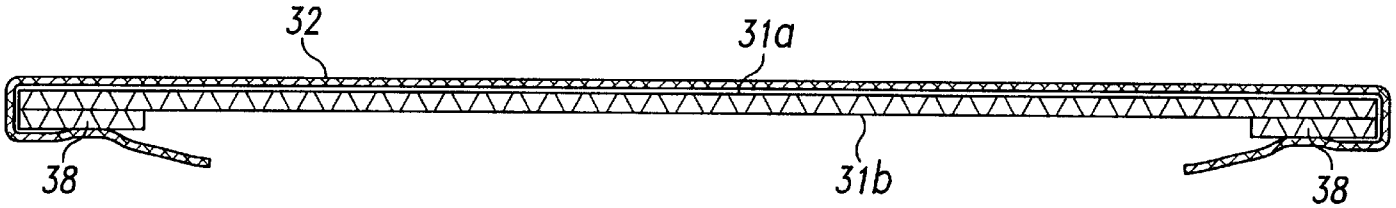
FIG. 5 shows a side cutaway view of the center panel of FIG. 4 after completion of the assembly process.

In general, the center panel 20 comprises a panel frame 30 (See FIG. 3) substantially covered by a section of flexible material 32 (See FIGS. 4 and 5). As shown in FIG. 3, the panel frame 30 includes a panel base 31 and a plurality of folded-under tabs 38, the panel base 31 having a first side 31*a* and a second side 31*b* (see FIGS. 4 and 5). Each of the folded-under tabs 38 are integrally formed with the panel base 31. In the exemplary embodiment described herein, the panel base 31 is constructed of corrugated paper and is substantially planar and rectangular in shape. Moreover, in this embodiment, the folded-under tabs 38 are trapezoidal in shape and extend from each edge of the panel base 31.

In the completely assembled center panel 20 (see FIG. 5), the folded-under tabs 38 are folded under a portion of the panel base 31, the fold defining at least a portion of a periphery 36 (see FIG. 3) of the panel base 31. Each of the folded-under tabs 38 are secured to the second side 31*b* of the panel base 31 preferably using adhesive, such as a thermoplastic or hot melt adhesive.

Figure 2:
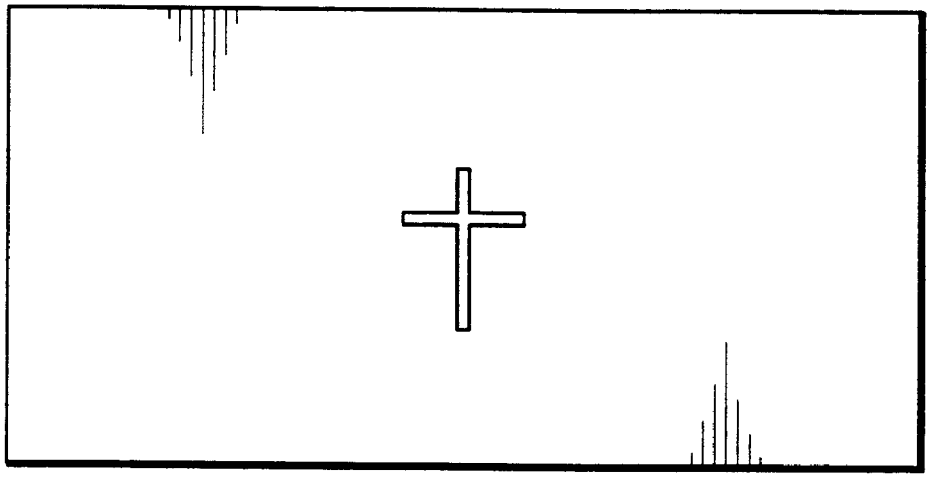
FIG. 2 shows a top view of two exemplary center panels according to the present invention.
Figure 2:
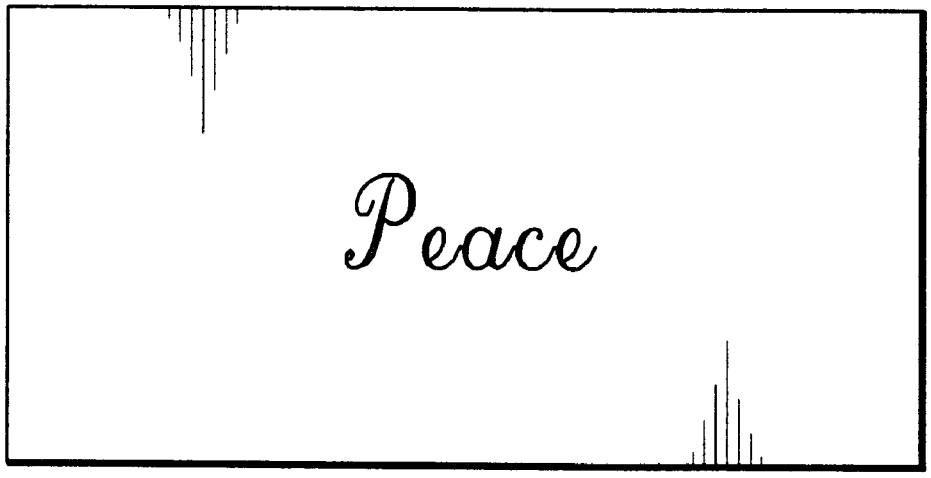

The section of flexible material 32 substantially covers the first side of the panel base 31 and is affixed to the folded-under tabs 38. The section of flexible material 32 may suitably be a velvet fabric, crepe material, nylon or silk fabric. The section of flexible material 32 may suitably carry decorative indicia, such as those relating to religious, personal, or other messages or symbols. The section of flexible material 32 is affixed to the folded-under tabs 38 using mechanical fasteners, such as staples, or adhesive, such as thermoplastic adhesive. FIG. 2 shows two exemplary center panels 20 in a fully assembled state from a top perspective view.

Referring again to FIG. 1, each of the plurality of rolls 18 includes an inner edge 18*a,* and an outer edge (hidden) affixed to the first casket top section 12. In particular, as is known in the art, commonly-available caskets typically include an overhang 13 that forms a peripheral channel (not shown) in the underside of the first casket top section 12. The channel receives the outer edge of each of the plurality of rolls 18 in a trap fit or interference fit. Each roll 18 has a sculpted shape that extends arcuately inward from the overhang 13 of the first casket top section 12 to the interior of the first casket top section 12. The inner edges 18*a* of said plurality of rolls collectively form a housing for receiving said center panel 20. In the exemplary embodiment described herein, the plurality of rolls 18 includes first, second, third and fourth rolls 18, each corresponding to one side of the rectangular center panel 20.

In a preferred embodiment, the inner edges 18*a* of the rolls 18 engage at least a portion of the periphery 36 of said center panel 20 in a friction or tension fit to secure the center panel 20 within the casket top interior assembly. To this end, the center panel 20 preferably has dimensions substantially equal to or slightly larger than the housing formed by the inner edges 18*a* of the rolls 18, thereby facilitating the tension or friction fit between the inner edges 18*a* and the center panel 20. Such a friction fit reduces assembly costs associated with stapling or securing the center panel 20 to the casket top by other means. Moreover, the friction fit allows the center panel 20 to be readily inserted outside the manufacturing environment. As a result, casket retailers may readily customize individual caskets by inserting center panels having select indicia into purchased caskets in accordance with the purchaser's individualized requirements.

It may in some circumstances be desirable to employ additional securing means to secure or help secure the center panel 20 within the casket top section 12. Such means could, for example, include a hook and loop fastening system, adhesive tape, or thermoplastic adhesive. Those of ordinary skill in the art may readily determine an appropriate securing means for their particular implementation.

In any event, the center panel 20 of the present invention provides the advantages of ease of manufacture by employing the folded-under tab design described above. The folded-under tab design facilitates relatively simple and reliable manufacturing methods, particularly associated with affixing the section of flexible material 32 to the panel frame 30 in a manner having reduced labor effort and higher accuracy.

Accordingly, one aspect of the present invention is a method of constructing a center panel for use in a casket top. By way of example, the method of constructing a center panel according to the present invention is described in connection with the center panel 20 of FIGS. 1 through 5. It will be noted, however, that the method of the present invention may readily by implemented to manufacture any suitable center panel that has a panel frame including a panel base and a plurality of tabs, wherein each of the plurality of tabs extend outward and are folded under from one of the edges of the panel base.

In general, the panel frame 30, which is preferably constructed of corrugated paper, is prepared and laid out with the folded-under tabs 38 extending outwardly from and generally coplanar with the panel base 31. FIG. 3, for example, shows the panel frame 30 so prepared and laid out. In an exemplary embodiment described herein, the panel frame 30 has a substantially rectangular shape with the corners removed to form diagonal corners 34. The diagonal corners 34 form the inclined edges of the trapezoidally-shaped folded-under tabs 38.

In accordance with a preferred method, the panel base 30 is slit-scored at the periphery 36 of the panel base 31. In particular, the panel frame 30 is slit-scored partially through the corrugated paper, preferably through all but the last layer. The slit-scoring of the panel frame 30 facilitates the folding under of the folded-under tabs 38 at the intended fold lines.

In any event, once the panel frame 30 is prepared and laid out as shown in FIG. 3, the section of flexible material 32 is disposed such that it substantially covers the first side 31*a* of the panel base 31 as shown in FIG. 4. If the section of flexible material 32 includes decorative indicia, the section of flexible material 32 is disposed such that the decorative indicia is visible and disposed at a desired location on the panel base 31.

The section of flexible material 32 is then affixed to the folded-under tabs 38 using staples, thermoplastic adhesive, or other suitable means. Once the section of flexible material 32 is secured to the folded-under tabs 38, the tabs 38 are folded under the panel base 31 and affixed thereto. The folding under of the tabs 38 causes the section of flexible material 32 to be more tightly engaged with the panel base 31.

The folded-under tabs 38 are then secured to the second side 31*b,* or underside, of the panel base 31. The folded-under tabs 38 may suitably be secured by a thermoplastic adhesive or other means.

The present invention thus reduces the manufacturing complexity of affixing a section of flexible material to a panel base for use in a casket top. Without the steps of affixing the flexible material and folding under the tabs taught by the present invention, the section of flexible material must somehow be tightly secured from the reverse side of the panel base, which not only is more difficult to handle, but can result in improper placement or centering of the decorative indicia on the panel base.

It will be appreciated that the above described embodiments of the present invention are merely illustrative, and that those of ordinary skill in the art may devise their own implementations that incorporate the principles of the present invention and fall within the spirit and scope thereof.

I claim:

1. A center panel for use in a casket top interior assembly, the casket top interior assembly employed in a casket top, the casket top interior assembly including a plurality of rolls adapted to substantially border the center panel, the center panel comprising:

a) a panel frame including a panel base and a plurality of folded-under tabs, the panel base having a first side and a second side, each of said folded-under tabs integrally formed with said panel base and folded under a portion of said panel base, thereby defining at least a portion of a periphery of the panel base, each of said folded-under tabs affixed to the second side of the panel base, and b) a section of flexible material substantially covering the first side of the panel base and affixed to said folded-under tabs.

2. The center panel of claim 1, wherein the section of flexible material includes decorative indicia.

3. The center panel of claim 1, wherein said panel base of said panel frame is substantially rectangular.

4. The center panel of claim 1, wherein said panel frame is constructed of corrugated paper.

5. The center panel of claim 1, wherein said section of flexible material is affixed to said folded-under tabs by mechanical fasteners.

6. The center panel of claim 1, wherein said section of flexible material is affixed to said folded-under tabs by thermoplastic adhesive.

7. The center panel of claim 1, wherein said folded-under tabs are affixed to the second side of the panel base by thermoplastic adhesive.

8. A casket top interior assembly for use in a casket top, the casket top interior assembly comprising:

a) a center panel further comprising a panel frame including a panel base and a plurality of folded-under tabs, the panel base having a first side and a second side, each of said folded-under tabs integrally formed with said panel base and folded under a portion of said panel base, thereby defining at least a portion of a periphery of the panel base, each of said folded-under tabs affixed to the second side of the panel base, and a section of flexible material substantially covering the first side of the panel base and affixed to said folded-under tabs; and b) a plurality of rolls, each roll having an outer edge configured to be affixed to a casket lid and an inner edge, each of said rolls configured to extend inward from a peripheral edge of said casket lid such that said inner edges of said plurality of rolls form a housing for receiving said center panel.

9. The casket top interior assembly of claim 8 wherein said inner edges of said rolls engage at least a portion of the periphery of said panel base through said section of flexible material in a friction fit to secure the center panel within the casket top interior assembly.

10. The casket top interior assembly of claim 8, wherein the section of flexible material includes decorative indicia.

11. The casket top interior assembly of claim 8, wherein said plurality of rolls consists essentially of first, second, third and fourth rolls and wherein said panel base of is substantially rectangular.

12. The casket top interior assembly of claim 8, wherein said panel frame is constructed of corrugated paper.

13. The casket top interior assembly of claim 8, wherein said section of flexible material is affixed to said folded-under tabs by mechanical fasteners.

14. The casket top interior assembly of claim 8, wherein said section of flexible material is affixed to said folded-under tabs by thermoplastic adhesive.

15. The casket top interior assembly of claim 8, wherein said folded-under tabs are affixed to the second side of the panel base by thermoplastic adhesive.

16. A method of constructing a center panel for use in a casket top, said center panel including a panel frame, said panel frame including a panel base and a plurality of tabs, each of said plurality of tabs extending outward from an edge of the panel base, the panel base having a first side and a second side, the method comprising:

a) disposing a section of flexible material to substantially cover the first side of the panel base;

b) affixing the section of flexible material to said tabs;

c) after step b), folding said tabs under the panel base and affixing said folded under tabs to the second side of the panel base.

17. The method of claim 16 wherein the panel base is constructed of corrugated paper, and further including, prior to step a), the step of:

slit scoring the panel frame partially through said panel frame at least a portion of each edge of the panel base to facilitate folding under said tabs.

18. The method of claim 16 wherein step a) further comprises disposing a section of flexible material to substantially cover the first side of the panel base, said flexible material including decorative indicia.

19. The method of claim 16 wherein step b) further comprises affixing the section of flexible material to said tabs using mechanical fasteners such as staples.

20. The method of claim 16 wherein step b) further comprises affixing the section of flexible material to said tabs using thermoplastic adhesive.

21. The method of claim 16 wherein in step c) further comprises affixing said folded-under tabs to the second side of the panel base using thermoplastic adhesive.

* * * * *

UNITED STATES PATENT AND TRADEMARK OFFICE

CERTIFICATE OF CORRECTION

PATENT NO. : 6,151,762
DATED : November 28, 2000
INVENTOR(S) : Gary L. Cox

It is certified that error appears in the above-identified patent and that said Letters Patent is hereby corrected as shown below:

Title page,
Item [73], the assignee's address should read as follows:
-- Richmond, Indiana --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*